US009200585B2

(12) United States Patent
Akazaki et al.

(10) Patent No.: US 9,200,585 B2
(45) Date of Patent: Dec. 1, 2015

(54) CONTROL APPARATUS FOR INTERNAL COMBUSTION ENGINE, METHOD OF CONTROLLING INTERNAL COMBUSTION ENGINE, AND COMPUTER-READABLE STORAGE MEDIUM

(71) Applicant: HONDA MOTOR CO., LTD., Tokyo (JP)

(72) Inventors: Shusuke Akazaki, Wako (JP); Yuji Yamamoto, Wako (JP); Satoshi Furuhashi, Wako (JP)

(73) Assignee: HONDA MOTOR CO., LTD., Tokyo (JP)

( * ) Notice: Subject to any disclaimer, the term of this patent is extended or adjusted under 35 U.S.C. 154(b) by 383 days.

(21) Appl. No.: 13/916,580

(22) Filed: Jun. 13, 2013

(65) Prior Publication Data

US 2013/0338906 A1 Dec. 19, 2013

(30) Foreign Application Priority Data

Jun. 19, 2012 (JP) ..... 2012-138175

(51) Int. Cl.

| | |
|---|---|
| ***F02D 41/30*** | (2006.01) |
| ***F02D 35/02*** | (2006.01) |
| *F02D 41/14* | (2006.01) |
| *F02D 41/28* | (2006.01) |

(52) U.S. Cl.

CPC ..... *F02D 41/3005* (2013.01); *F02D 35/023* (2013.01); *F02D 2041/1432* (2013.01); *F02D 2041/281* (2013.01); *F02D 2041/286* (2013.01)

(58) Field of Classification Search

CPC ... F02D 35/021; F02D 35/025; F02D 35/028; F02D 41/30; F02D 41/3005; F02D 2041/281; F02D 2041/286

USPC ..... 701/102–105, 111, 114, 115; 123/406.14, 406.21, 406.22, 406.27; 73/114.02, 114.07, 114.08

See application file for complete search history.

(56) References Cited

U.S. PATENT DOCUMENTS

| | | | | |
|---|---|---|---|---|
| 2009/0018747 | A1* | 1/2009 | Nitta | 701/102 |
| 2010/0312456 | A1* | 12/2010 | Nishimura et al. | 701/103 |
| 2011/0224889 | A1* | 9/2011 | Imamura et al. | 701/111 |
| 2013/0036803 | A1* | 2/2013 | Itou et al. | 73/114.18 |

FOREIGN PATENT DOCUMENTS

| | | |
|---|---|---|
| JP | 4241581 B2 | 6/2006 |
| JP | 2010-285870 | 12/2010 |

* cited by examiner

*Primary Examiner* — John Kwon
*Assistant Examiner* — Johnny H Hoang
(74) *Attorney, Agent, or Firm* — Mori & Ward, LLP

(57) ABSTRACT

A control apparatus for an internal combustion engine includes a cylinder internal pressure sensor, a fuel injection parameter calculator, a driving device, and a sensor output signal processing device. The sensor output signal processing device is configured to set a noise reduction period in accordance with an opening time and an opening start time of a fuel injection valve and is configured to reduce, during the noise reduction period, noise that is included in a cylinder internal pressure sensor output signal and that is caused by opening of the fuel injection valve.

13 Claims, 9 Drawing Sheets

FIG. 4C PCYL

FIG. 4D PCNR

CAPFI

IDRV
PCYL

CAPF
CAPL
CAIS
CAIC
CAIE

CAPNR
CANS
CANE
CA

CONTROL APPARATUS FOR INTERNAL COMBUSTION ENGINE, METHOD OF CONTROLLING INTERNAL COMBUSTION ENGINE, AND COMPUTER-READABLE STORAGE MEDIUM

CROSS-REFERENCE TO RELATED APPLICATIONS

The present application claims priority under 35 U.S.C. §119 to Japanese Patent Application No. 2012-138175, filed Jun. 19, 2012, entitled "Control Apparatus for Internal Combustion Engine." The contents of this application are incorporated herein by reference in their entirety.

BACKGROUND OF THE INVENTION

1. Field of the Invention

The present disclosure relates to a control apparatus for an internal combustion engine, a method of controlling the internal combustion engine, and a computer-readable storage medium.

2. Discussion of the Background

Japanese Unexamined Patent Application Publication No. 2010-285870 discloses a control apparatus that detects instantaneous interruption in which a cylinder internal pressure signal detected by a cylinder internal pressure sensor instantaneously disappears and that, when the instantaneous interruption frequently occurs, stops control of a fuel injection period based on the cylinder internal pressure signal. The instantaneous interruption of the cylinder internal pressure signal is considered to occur due to activation of an engine when an output terminal of the cylinder internal pressure sensor is corroded or abraded.

SUMMARY OF THE INVENTION

According to one aspect of the present invention, a control apparatus for an internal combustion engine includes a cylinder internal pressure sensor, a fuel injection parameter calculator, a driving device, and a sensor output signal processing device. The cylinder internal pressure sensor is to be integrated with a fuel injection valve provided to inject fuel into a combustion chamber of the internal combustion engine. The cylinder internal pressure sensor is configured to detect cylinder internal pressure in the combustion chamber. The fuel injection parameter calculator is configured to calculate an opening time and an opening start time of the fuel injection valve in accordance with an operation state of the internal combustion engine. The driving device is to drive the fuel injection valve in accordance with the opening time and the opening start time that are calculated by the fuel injection parameter calculator. The sensor output signal processing device is configured to generate a cylinder internal pressure detection signal based on a cylinder internal pressure sensor output signal output from the cylinder internal pressure sensor. The sensor output signal processing device is configured to set a noise reduction period in accordance with the opening time and the opening start time of the fuel injection valve and is configured to reduce, during the noise reduction period, noise that is included in the cylinder internal pressure sensor output signal and that is caused by opening of the fuel injection valve.

According to another aspect of the present invention, in a method of controlling an internal combustion engine, cylinder internal pressure in a combustion chamber of the internal combustion engine is detected using a cylinder internal pressure sensor integrated with a fuel injection valve provided to inject fuel into the combustion chamber. An opening time and an opening start time of the fuel injection valve are calculated in accordance with an operation state of the internal combustion engine. The fuel injection valve is driven in accordance with the opening time and the opening start time that are calculated in the calculating of the opening time and the opening start time. A cylinder internal pressure detection signal is generated based on the cylinder internal pressure detected in the detecting of the cylinder internal pressure. A noise reduction period is set in accordance with the opening time and the opening start time of the fuel injection valve. During the noise reduction period, noise that is included in a signal of the cylinder internal pressure detected in the detecting of the cylinder internal pressure and that is caused by opening of the fuel injection valve is reduced.

According to further aspect of the present invention, a computer-readable storage medium stores a program for causing a computer to execute a process. In the process, cylinder internal pressure in a combustion chamber of the internal combustion engine is detected using a cylinder internal pressure sensor integrated with a fuel injection valve provided to inject fuel into the combustion chamber. An opening time and an opening start time of the fuel injection valve are calculated in accordance with an operation state of the internal combustion engine. The fuel injection valve is driven in accordance with the opening time and the opening start time that are calculated in the calculating of the opening time and the opening start time. A cylinder internal pressure detection signal is generated based on the cylinder internal pressure detected in the detecting of the cylinder internal pressure. A noise reduction period is set in accordance with the opening time and the opening start time of the fuel injection valve. During the noise reduction period, noise that is included in a signal of the cylinder internal pressure detected in the detecting of the cylinder internal pressure and that is caused by opening of the fuel injection valve is reduced.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 4A to 4D are time charts for describing an $\epsilon$ filter process for reducing the fuel injection noise;

DESCRIPTION OF THE EMBODIMENTS

Figure 1:
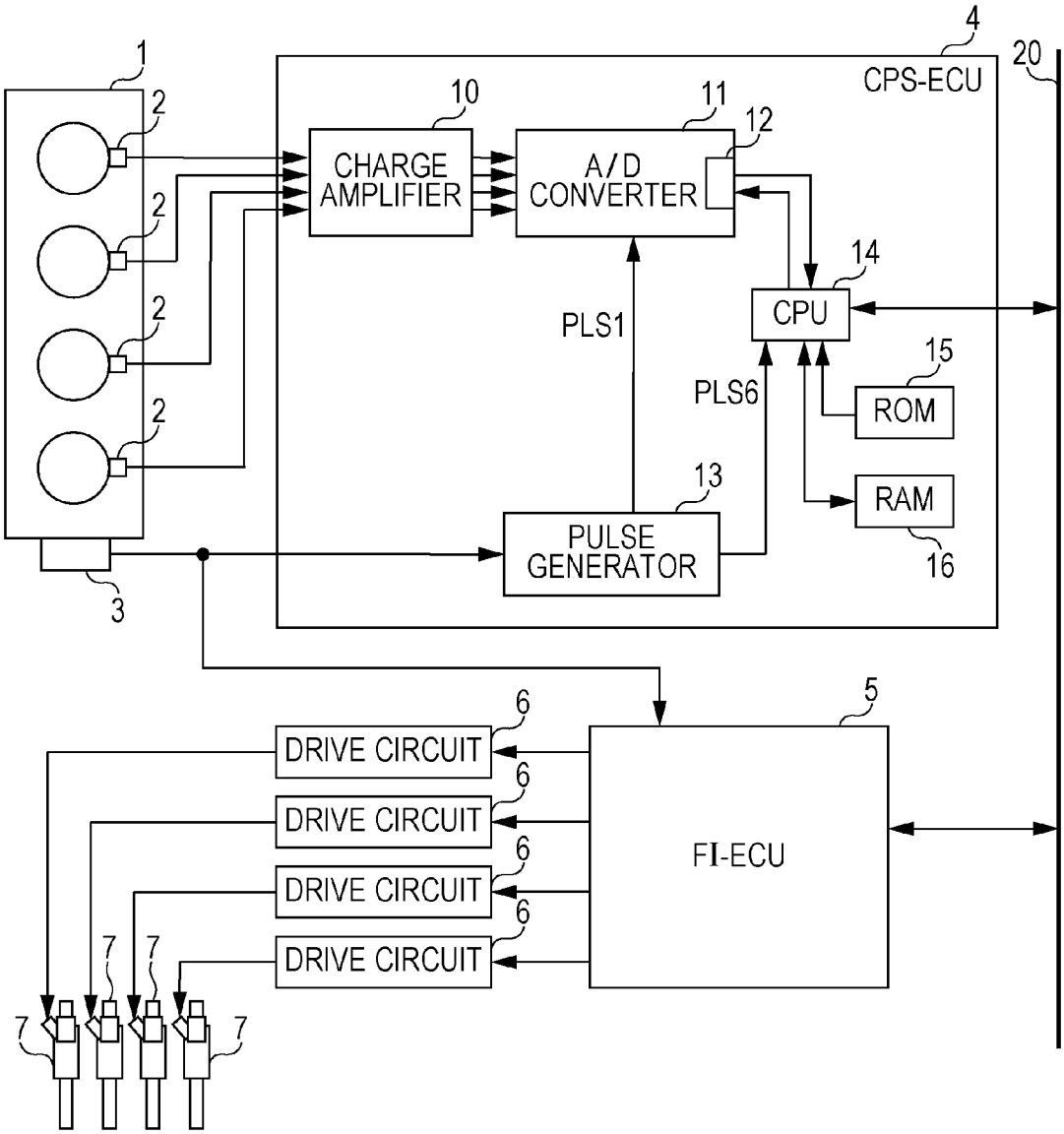
FIG. 1 illustrates an example of the configuration of an internal combustion engine and a control apparatus therefor according to an embodiment of the present disclosure.

The applicants of the present disclosure are developing a cylinder internal pressure sensor integrated with a fuel injection valve that directly injects fuel into a combustion chamber of an engine. A cylinder internal pressure signal detected by the cylinder internal pressure sensor may include large noise (hereinafter referred to as "fuel injection noise") due to activation of the fuel injection valve. Since the size of the fuel injection noise may be the same order of the variation in signal waveform caused by the instantaneous interruption disclosed in Japanese Unexamined Patent Application Publication No. 2010-285870, it is difficult to reduce the fuel injection noise by a general noise reduction filter. In addition, since the fuel injection noise constantly occurs, unlike the instantaneous interruption of the cylinder internal pressure signal, the fuel injection noise fails to be addressed by the stop of the control of the fuel injection period based on the cylinder internal pressure signal in the apparatus disclosed in Japanese Unexamined Patent Application Publication No. 2010-285870.

The embodiments will now be described with reference to the accompanying drawings, wherein like reference numerals designate corresponding or identical elements throughout the various drawings.

Figure 2:
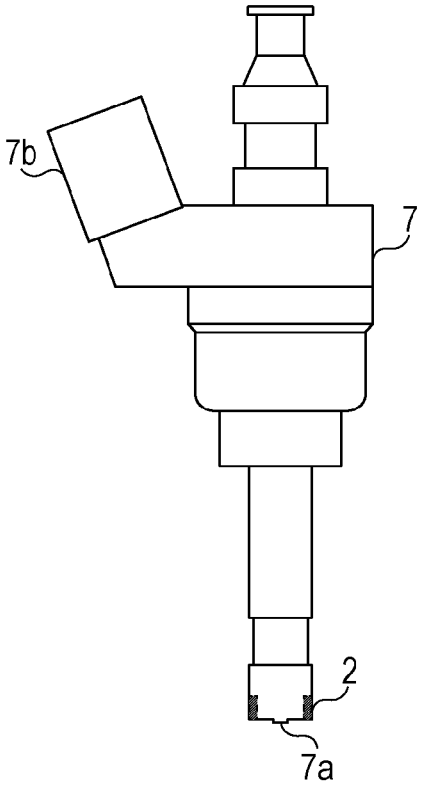
FIG. 2 is a diagram for describing the arrangement of a cylinder internal pressure sensor integrated with a fuel injection valve.

FIG. 1 illustrates an example of the configuration of a control apparatus for an internal combustion engine according to an embodiment of the present disclosure. Referring to FIG. 1, a cylinder internal pressure sensor 2 that detects cylinder internal pressure PCYL is provided for each cylinder in a four-cylinder direct injection internal combustion engine (hereinafter referred to as an "engine") 1. In the present embodiment, the cylinder internal pressure sensor 2 is integrated with a fuel injection valve 7 provided in each cylinder, as illustrated in FIG. 2. FIG. 1 is a diagram for describing a control system and the cylinder internal pressure sensors 2 are illustrated separately from the fuel injection valves 7 in FIG. 1.

The cylinder internal pressure sensor 2 is composed of a ring-shaped piezoelectric element and is arranged so as to surround an injection nozzle 7*a* of the fuel injection valve 7. A connection line through which a signal detected by the cylinder internal pressure sensor 2 is output and a connection line through which a drive signal is supplied to the fuel injection valve 7 are connected to a cylinder internal pressure detection-electronic control unit (hereinafter referred to as a "CPS-ECU") 4 and a drive circuit 6 for each fuel injection valve 7 via a connection portion 7*b*. Each drive circuit 6 is connected to an engine control-electronic control unit (hereinafter referred to as an "FI-ECU") 5 and a fuel injection valve drive signal is supplied from the FI-ECU 5 to each drive circuit 6. With this configuration, the fuel injection valve 7 is opened in response to the drive signal supplied from the FI-ECU 5 and the fuel of an amount corresponding to the opening time of the fuel injection valve 7 is injected into a combustion chamber in each cylinder.

The engine 1 is provided with a crank angle position sensor 3 that detects a rotation angle of a crank shaft (not illustrated). The crank angle position sensor 3 generates a pulse signal on a cycle of a one-degree crank angle, a pulse signal on a cycle of a 180-degree crank angle, and a pulse signal on a cycle of a 720-degree crank angle and supplies the pulse signals to the CPS-ECU 4 and the FI-ECU 5.

The CPS-ECU 4 includes a charge amplifier 10, an analog-to-digital (A/D) converter 11, a pulse generator 13, a central processing unit (CPU) 14, a read only memory (ROM) 15 storing programs executed by the CPU 14, and a random access memory (RAM) 16 in which the CPU 14 stores data about the cylinder internal pressure that is detected, arithmetic results, and so on. The detection signal detected by each cylinder internal pressure sensor 2 is supplied to the charge amplifier 10. The charge amplifier 10 amplifies the signals that are input while integrating the signals. The signals integrated and amplified by the charge amplifier 10 are supplied to the A/D converter 11. The pulse signals output from the crank angle position sensor 3 are supplied to the pulse generator 13. The charge amplifier 10 is composed of an operational amplifier, a capacitor, a resistor, and so on. The signal output from the charge amplifier 10 is denoted by a cylinder internal pressure sensor output signal PCYL in this specification.

The A/D converter 11 includes a buffer 12. The A/D converter 11 converts a cylinder internal pressure detection signal supplied from the charge amplifier 10 into a digital value and stores the digital value in the buffer 12. More specifically, the pulse signal on a cycle of a one-degree crank angle (hereinafter referred to as a "one-degree pulse") PLS1 is supplied from the pulse generator 13 to the A/D converter 11. The A/D converter 11 samples the cylinder internal pressure detection signal on a cycle of the one-degree pulse PLS1, converts the cylinder internal pressure detection signal into a digital value, and stores the digital value in the buffer 12.

A pulse signal PLS6 on a cycle of a six-degree crank angle is supplied from the pulse generator 13 to the CPU 14. The CPU 14 reads out the digital value stored in the buffer 12 on a cycle of the six-degree pulse PLS6.

The FI-ECU 5 includes an input circuit including an A/D converter circuit, a CPU, a ROM, a RAM, and an output circuit. The FI-ECU 5 calculates control parameters (fuel injection parameters INJSTG, TOFF, and TON) of the fuel injection valve 7 and an ignition time of an ignition plug (not illustrated) in accordance with engine operation parameters, such as an amount of intake air flow GAIR, an intake air pressure PBA, a cooling water temperature TW, and an intake air temperature TA of the engine 1, detected by sensors (not illustrated), in addition to a number of revolutions NE of the engine calculated on the basis of the pulse signals supplied from the crank angle position sensor 3, to control the amount of fuel supply and the ignition time.

The CPS-ECU 4 is connected to the FI-ECU 5 via a data bus 20. The CPS-ECU 4 transmits and receives necessary data to and from the FI-ECU 5 via the data bus 20.

Figure 3:
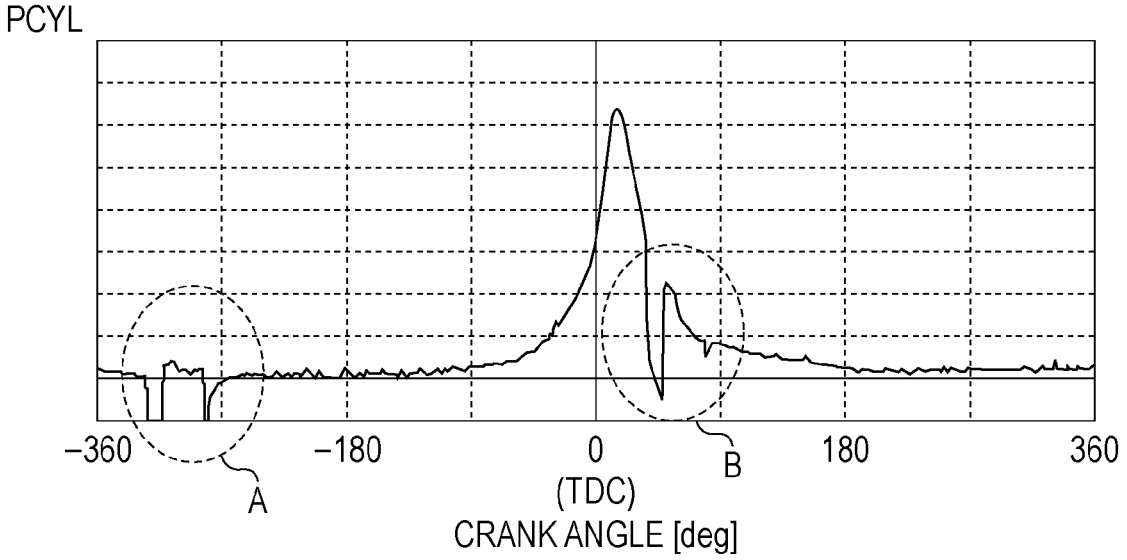
FIG. 3 is a time chart illustrating noise (fuel injection noise) caused by the opening of the fuel injection valve.

FIG. 3 is a time chart for specifically describing the problems of the present disclosure. FIG. 3 illustrates how the cylinder internal pressure sensor output signal PCYL is varied. Since the use of the cylinder internal pressure sensor 2 integrated with the fuel injection valve illustrated in FIG. 2 causes a valve opening drive signal of the fuel injection valve to be mixed into the cylinder internal pressure sensor output signal PCYL as the noise (the fuel injection noise), the waveform of the detection signal is greatly varied in an portion A and a portion B in FIG. 3. The fuel injection noise indicated in the portion B appears when a configuration in which one drive circuit is provided for two fuel injection valves 7 is adopted. In this case, the fuel injection noise of the fuel injection valves different from the fuel injection valves to which the cylinder internal pressure sensors 2 are mounted is mixed into the cylinder internal pressure sensor output signal PCYL through a common drive circuit. In the present embodiment, the drive circuits 6 are provided for the four respective fuel injection valves 7 and the noise indicated in the portion B in FIG. 3 is reduced by this configuration.

In contrast, the fuel injection noise indicated in the portion A in FIG. 3 is reduced by a process of reducing the noise in the cylinder internal pressure sensor output signal, as described below. The noise reduction process will be roughly described with reference to FIGS. 4A to 5B.

Figure 4A:
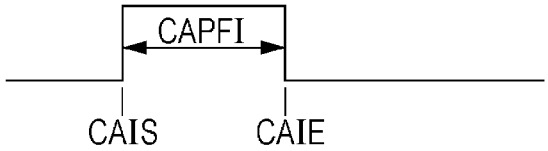
Figure 4B:
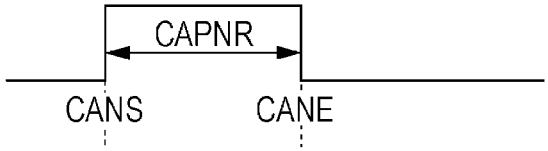
Figure 4B:
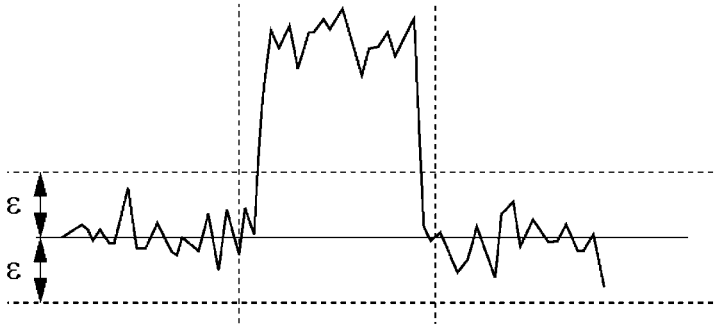
Figure 4B:
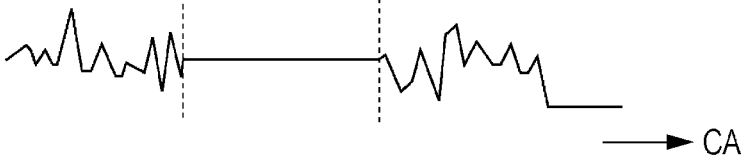

As illustrated in FIG. 4A and FIG. 4B, a noise reduction period CAPNR is set so as to include a fuel injection execution period CAPFI in which the fuel injection noise is caused. When the noise reduction period CAPNR does not include a compression process period (hereinafter referred to as a "cylinder internal pressure increasing period") CAPPUP in which the cylinder internal pressure sensor output signal PCYL increases, an $\epsilon$ filter process is used to reduce the fuel injection noise, as illustrated in FIG. 4C. In other words, with the $\epsilon$ filter process, a cylinder internal pressure signal after the noise reduction PCNR is set to the cylinder internal pressure sensor output signal PCYL (Equation (2) described below) if Equation (1) is established and is set to a last average PCYLAV (Equation (3) described below) if Equation (1) is not established (that is, PCYL<PCYLAV−$\epsilon$ or PCYL>PCYLAV+$\epsilon$ is established). The last average PCYLAV is an average of the values of detection data of a certain number N0 (for example, 10), which are acquired during a certain averaging period CAPAV (for example, a period of about a ten-degree crank angle) immediately before a start time CANS of the noise reduction period CAPNR. The above $\epsilon$ is a certain allowable range predetermined value that is set in advance in accordance with the size of the fuel injection noise.

$$PCYLAV-\epsilon \leq PCYL \leq PCYLAV+\epsilon \quad (1)$$

$$PCNR=PCYL \quad (2)$$

$$PCNR=PCYLAV \quad (3)$$

The cylinder internal pressure signal after the noise reduction PCNR results in a signal illustrated in FIG. 4D by the $\epsilon$ filter process. The fuel injection noise is reduced in FIG. 4D.

Figure 5A:
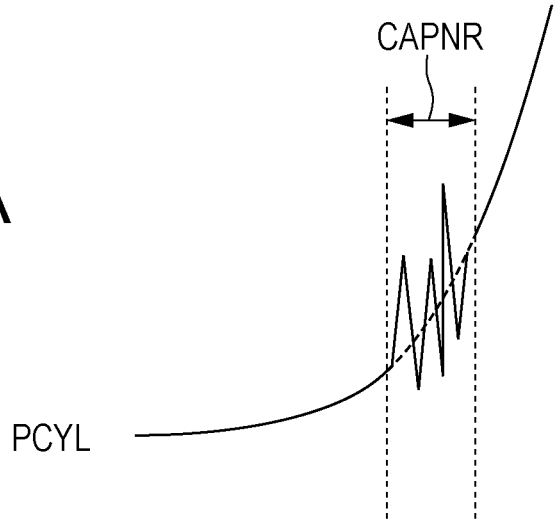
FIGS. 5A and 5B are time charts for describing a previous value replacement process for reducing the fuel injection noise.
Figure 5B:
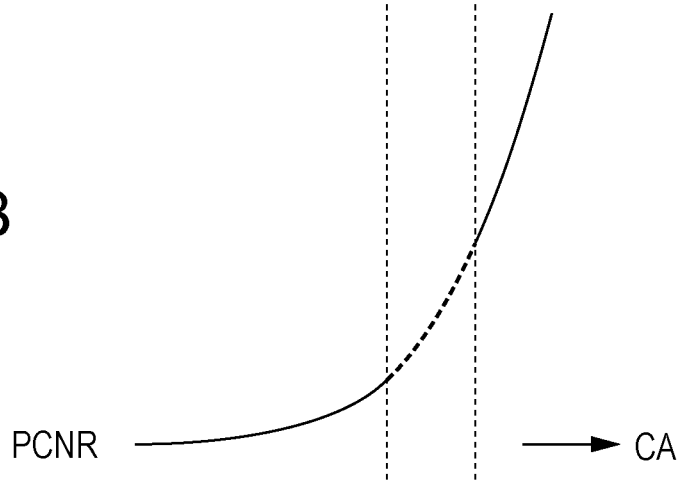

FIG. 5A and FIG. 5B illustrate examples in which the cylinder internal pressure increasing period CAPPUP is included in the noise reduction period CAPNR. The normal fuel injection execution period CAPFI is set before the cylinder internal pressure increasing period CAPPUP is started. However, for example, when additional fuel injection is performed, in addition to the main injection performed at the above timing, the fuel injection noise occurs at timing illustrated in FIG. 5A. In such a case, for example, no fuel injection noise is superposed on the cylinder internal pressure sensor output signal PCYL detected before one combustion cycle (a crank angle of 720 degrees), as illustrated by an alternate long and short dash line in FIG. 5A. Accordingly, the cylinder internal pressure sensor output signal PCYL is stored over at least one combustion cycle and the cylinder internal pressure signal after the noise reduction PCNR is set to a storage value PCYLZ at the corresponding crank angle during the noise reduction period CAPNR (refer to Equation (4)):

$$PCNR=PCYLZ \quad (4)$$

A previous value replacement process described above results in the cylinder internal pressure signal after the noise reduction PCNR illustrated in FIG. 5B.

Since the process of generating the cylinder internal pressure signal after the noise reduction PCNR from the cylinder internal pressure sensor output signal PCYL is performed in the CPS-ECU 4 in the present embodiment, the fuel injection parameters necessary to determine the noise reduction period CAPNR, specifically, a fuel injection reference stage INJSTG, a fuel injection waiting time TOFF, and a fuel injection valve opening time TON are transmitted from the FI-ECU 5 via the data bus 20. The relationship in the FI-ECU 5 between a time when the fuel injection parameters INJSTG, TOFF, and TON are calculated, a fuel injection start time CAIS, and a transmission time CASND when the fuel injection parameters INJSTG, TOFF, and TON are transmitted will now be described with reference to FIG. 6.

Figure 6:
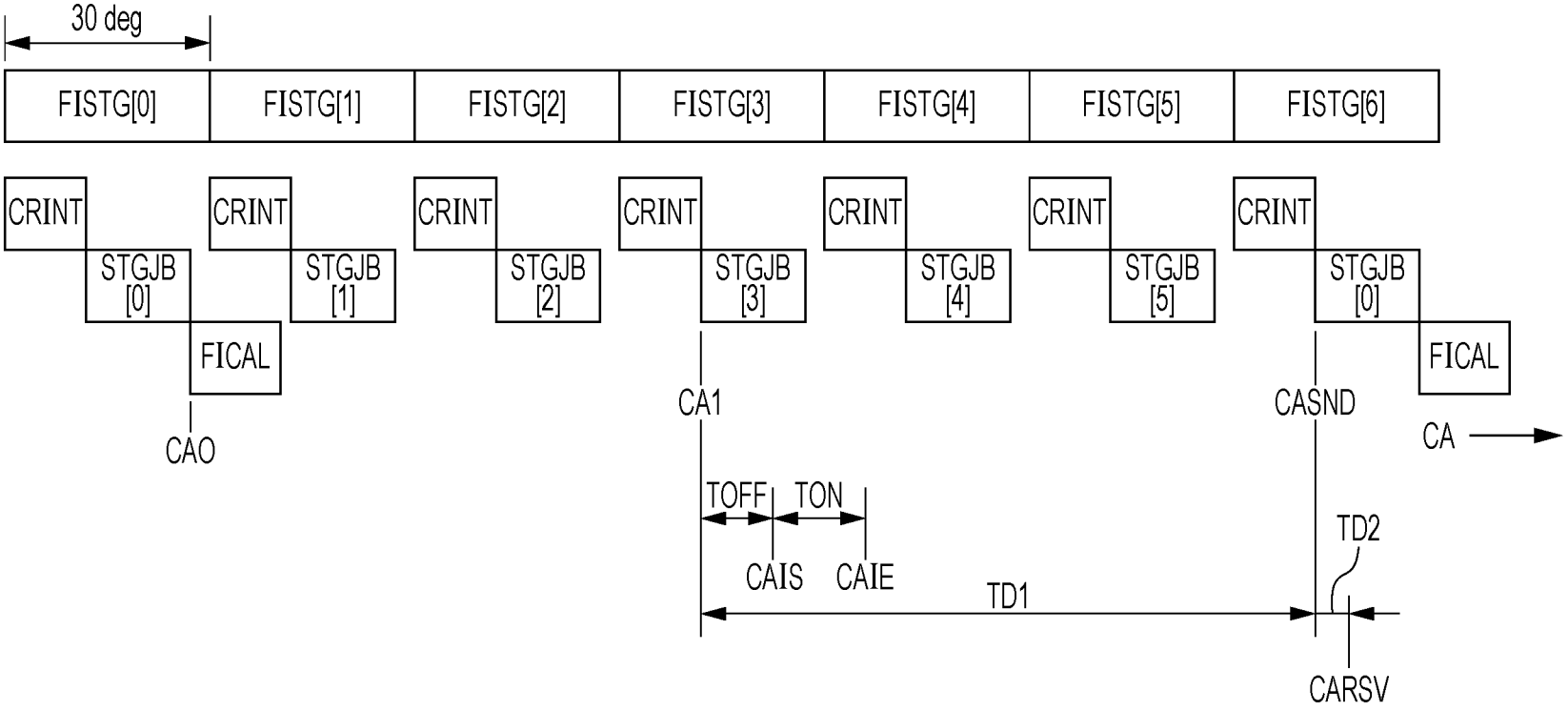
FIG. 6 is a time chart for describing the execution times of processes concerning the fuel injection.

A stage FISTG[n] (n=0 to 23) illustrated in FIG. 6 is a label added to a period for every 30-degree crank angle. A CRK interruption process CRINT is started at a start time of each stage FISTG, a stage process STGJB[k] (k=0 to 5) is started at an end time of the CRK interruption process CRINT, and a fuel injection parameter calculating process (FICAL process) is started at an end time CAO of the stage process STGJB[0].

For example, when the fuel injection reference stage INJSTG is "3", a start time timer TMOFF is set to the fuel injection waiting time TOFF at a start time CA1 of the stage FISTG[3] to start the fuel injection and an end time timer TMON is set to the fuel injection valve opening time TON. Then, the fuel injection valve 7 is opened at a time (the fuel injection start time) CAIS when the value of the start time timer TMOFF becomes "0", the end time timer TMON is started, and the fuel injection valve 7 is closed at a time (a fuel injection end time) CAIS when the value of the end time timer TMON becomes "0". The fuel injection based on the fuel injection parameters calculated in the fuel injection parameter calculating process FICAL is performed in the above manner.

In the above example, the transmission time CASND of the fuel injection parameters corresponds to a start time of the stage process STGJB[0] at the stage FISTG[6] and transmission of the fuel injection parameters is performed behind a first delay time TD1 from the start time (fuel injection reference time) CA1 in the FI-ECU 5. A reception time CARSV in the CPS-ECU 4 is behind a second delay time TD2 corresponding to the data transmission time from the transmission time CASND. Accordingly, it is necessary to set the noise reduction period CAPNR in consideration of the first delay time TD1 and the second delay time TD2 in the CPS-ECU 4.

Specifically, a reception fuel injection waiting time TOFFR is calculated according to Equation (5), and the reception fuel injection waiting time TOFFR and the fuel injection valve opening time TON are converted into a reception fuel injection waiting angle period CAPOFFR and a fuel injection valve opening angle period CAPON, respectively, in accordance with the number of revolutions NE of the engine at that time. Since TOFF<(TD1+TD2) in the example in FIG. 6, the reception fuel injection waiting time TOFFR calculated according to Equation (5) takes a negative value.

$$TOFFR=TOFF-(TD1+TD2) \quad (5)$$

Then, the reception time CARSV and the reception fuel injection waiting angle period CAPOFFR are applied to Equation (6) to calculate the fuel injection start time CAIS, and the fuel injection start time CAIS and the fuel injection valve opening angle period CAPON are applied to Equation (7) to calculate the fuel injection end time CAIE:

$$CAIS=CARSV+CAPOFFR \quad (6)$$

$$CAIE=CAIS+CAPON \quad (7)$$

The fuel injection start time CAIS and the fuel injection end time CAIE are applied to Equation (8) and Equation (9), respectively, to determine the noise reduction start time CANS and a noise reduction end time CANE:

$$CANS=CAIS-CAPMGN \quad (8)$$

$$CANE=CAIE+CAPMGN \quad (9)$$

where CAPMGN denotes a certain margin period set to, for example, a five-degree crank angle.

Figure 7A:
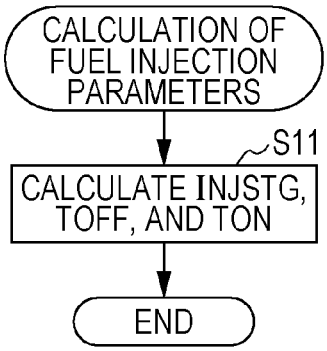
FIGS. 7A to 7C are flowcharts illustrating examples of processes concerning the fuel injection.
Figure 7B:
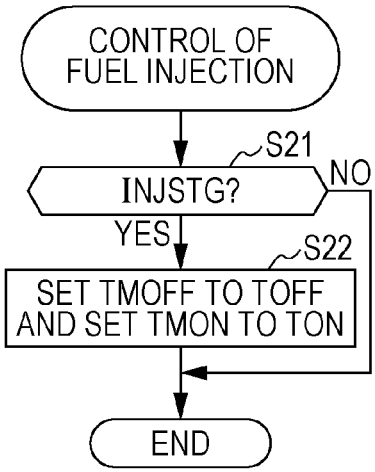
Figure 7C:
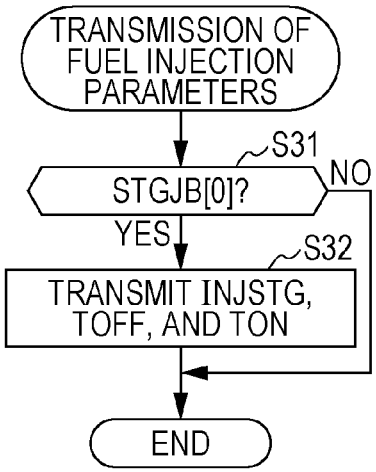

FIG. 7A, FIG. 7B, and FIG. 7C are flowcharts illustrating exemplary processes performed in the FI-ECU 5. FIG. 7A is a flowchart illustrating an example of the fuel injection parameter calculating process FICAL. Referring to FIG. 7A, in Step S11, the FI-ECU 5 calculates the fuel injection reference stage INJSTG, the fuel injection waiting time TOFF, and the fuel injection valve opening time TON in accordance with the operation state of the engine.

FIG. 7B is a flowchart illustrating an example of a fuel injection control process performed at the stage process STGJB. Referring to FIG. 7B, in Step S21, the FI-ECU 5 determines whether the current stage corresponds to the fuel injection reference stage INJSTG. If the FI-ECU 5 determines that the current stage corresponds to the fuel injection reference stage INJSTG (YES in Step S21), in Step S22, the start time timer TMOFF is set to the fuel injection waiting time TOFF to start the fuel injection and the end time timer TMON is set to the fuel injection valve opening time TON. The end time timer TMON starts down counting when the value of the start time timer TMOFF becomes "0." If the FI-ECU 5 determines that the current stage does not correspond to the fuel injection reference stage INJSTG (NO in Step S21), the fuel injection control process is terminated.

FIG. 7C is a flowchart illustrating an example of a process of transmitting fuel injection parameters, performed at the stage process STGJB. Referring to FIG. 7C, in Step S31, the FI-ECU 5 determines whether the current stage process corresponds to the stage process STGJB[0]. If the FI-ECU 5 determines that the current stage process corresponds to the stage process STGJB[0] (YES in Step S31), in Step S32, the FI-ECU 5 transmits the fuel injection parameters INJSTG, TOFF, and TON calculated in the process in FIG. 7A. If the FI-ECU 5 determines that the current stage process does not correspond to the stage process STGJB[0] (NO in Step S31), the process of transmitting fuel injection parameters is terminated.

Figure 8:
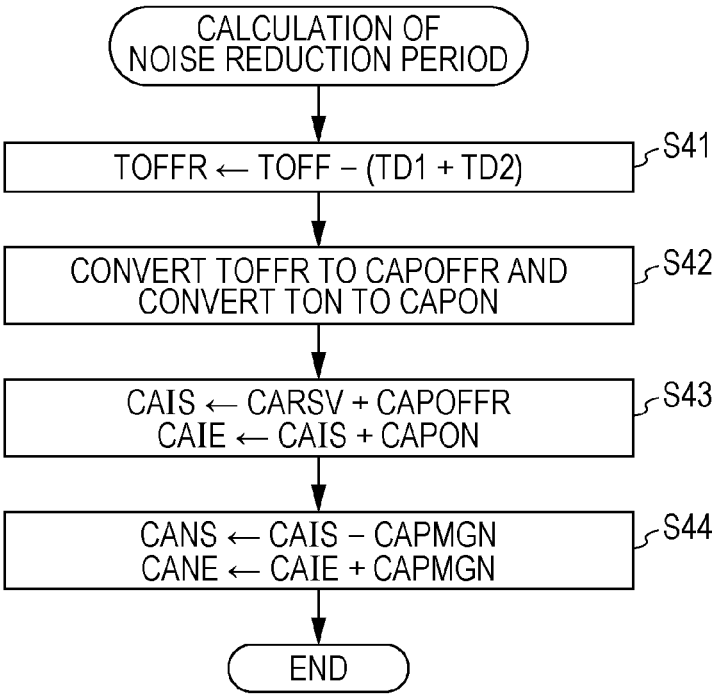
FIG. 8 is a flowchart illustrating an example of a process of calculating a noise reduction period.

FIG. 8 is a flowchart illustrating an example of a process of calculating the noise reduction period, performed in the CPS-ECU 4. The process of calculating the noise reduction period is performed at the reception time CARSV of the fuel injection parameters illustrated in FIG. 6.

Referring to FIG. 8, in Step S41, the CPS-ECU 4 calculates the reception fuel injection waiting time TOFFR according to Equation (5). In Step S42, the CPS-ECU 4 converts the reception fuel injection waiting time TOFFR into the reception fuel injection waiting angle period CAPOFFR and converts the fuel injection valve opening time TON into the fuel injection valve opening angle period CAPON in accordance with the number of revolutions NE of the engine.

In Step S43, the CPS-ECU 4 calculates the fuel injection start time CAIS and the fuel injection end time CAIE according to Equation (6) and Equation (7), respectively. In Step S44, the CPS-ECU 4 calculates the noise reduction start time CANS and the noise reduction end time CANE according to Equation (8) and Equation (9), respectively. The angle period from the noise reduction start time CANS to the noise reduction end time CANE corresponds to the noise reduction period CAPNR.

When the additional fuel injection is performed, the fuel injection parameters corresponding to the additional fuel injection are also transmitted from the FI-ECU 5 to the CPS-ECU 4 to set the noise reduction period CAPNR corresponding to the additional fuel injection.

Figure 9:
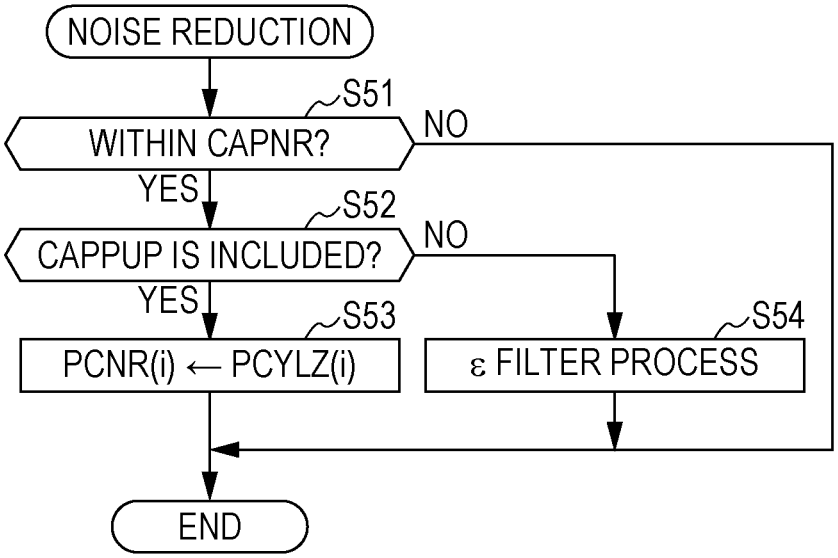
FIG. 9 is a flowchart illustrating an example of a noise reduction process.

FIG. 9 is a flowchart illustrating an example of the noise reduction process, performed in the CPS-ECU 4. The noise reduction process is performed in response to reading of cylinder internal pressure sensor output signal data PCYL (i) (I=0 to 719) stored in the RAM 16.

Referring to FIG. 9, in Step S51, the CPS-ECU 4 determines whether the cylinder internal pressure sensor output signal data PCYL (i) that is read is within the noise reduction period CAPNR. If the cylinder internal pressure sensor output signal PCYL(i) that is read is within the noise reduction period CAPNR (YES in Step S51), in Step S52, the CPS-ECU 4 determines whether the noise reduction period CAPNR includes the cylinder internal pressure increasing period CAPPUP.

If the CPS-ECU 4 determines that the noise reduction period CAPNR does not include the cylinder internal pressure increasing period CAPPUP (NO in Step S52), in Step S54, the CPS-ECU 4 reduces the fuel injection noise by the $\epsilon$ filter process.

If the CPS-ECU 4 determines that the noise reduction period CAPNR includes the cylinder internal pressure increasing period CAPPUP (YES in Step S52), that is, if the noise reduction period CAPNR is in the manner illustrated in FIG. 5A, in Step S53, the CPS-ECU 4 reduces the fuel injection noise by the previous value replacement process.

If the cylinder internal pressure sensor output signal PCYL (i) that is read is not within the noise reduction period CAPNR (NO in Step S51), the noise reduction process is terminated.

The cylinder internal pressure signal after the noise reduction PCNR is applied to determination of the combustion state of the engine 1 and the control of the fuel injection period disclosed in Japanese Unexamined Patent Application Publication No. 2010-285870.

As described above, according to the present embodiment, the noise reduction period CAPNR is set in accordance with the fuel injection execution period CAPFI determined by the fuel injection parameters and the process of reducing the fuel injection noise included in the cylinder internal pressure sensor output signal PCYL is performed during the noise reduction period CAPNR. Since the fuel injection noise occurs while the fuel injection is being performed, the setting of the noise reduction period CAPNR in accordance with the fuel injection execution period CAPFI allows the noise reduction period CAPNR to be appropriately set. Performing an arithmetic process having a noise reduction effect higher than that of the normal filter process, that is, the $\epsilon$ filter process or the previous value replacement process during the noise reduction period CAPNR allows the fuel injection noise to be effectively reduced.

More specifically, when the noise reduction period CAPNR does not include the cylinder internal pressure increasing period CAPPUP in which the cylinder internal pressure increases, the cylinder internal pressure sensor output signal PCYL is directly output as the cylinder internal pressure signal after the noise reduction PCNR if the cylinder internal pressure sensor output signal PCYL is within a first allowable range defined by (the last average PCYLAV$\pm\epsilon$), the last average PCYLAV is output as the cylinder internal pressure signal after the noise reduction PCNR if the cylinder internal pressure sensor output signal PCYL is outside the first allowable range, and the last average PCYLAV is set to the average of the values of the cylinder internal pressure sensor output signal data of the certain number N0 immediately before the noise reduction period CAPNR. Since the fuel injection is performed before the cylinder internal pressure starts to increase or while the cylinder internal pressure is increasing, it is possible to approximate the cylinder internal pressure signal after the noise reduction PCNR to a constant value when the noise reduction period does not include the cylinder internal pressure increasing period. Accordingly, setting the cylinder internal pressure signal after the noise reduction PCNR to the last average PCYLAV when the cylinder internal pressure sensor output signal PCYL is outside the first allowable range allows the large fuel injection noise to be appropriately reduced.

In contrast, when the noise reduction period CAPNR includes the cylinder internal pressure increasing period CAPPUP, the cylinder internal pressure signal after the noise reduction PCNR during the noise reduction period CAPNR is set to the cylinder internal pressure sensor output signal PCYL acquired before one combustion cycle. Since the fuel injection performed during the cylinder internal pressure increasing period CAPPUP is the additional fuel injection after the main injection and is not constantly performed, the application of the cylinder internal pressure sensor output signal PCYL acquired before one combustion cycle allows the fuel injection noise during the cylinder internal pressure increasing period CAPPUP to be appropriately reduced.

The noise reduction start time CANS of the noise reduction period CAPNR is set to a time the certain margin period CAPMGN before the fuel injection start time CAIS, and the noise reduction end time CANE of the noise reduction period CAPNR is set to a time when the fuel injection execution period CAPFI and the certain margin period CAPMGN elapsed since the fuel injection start time CAIS. Accordingly, it is possible to reliably reduce the fuel injection noise.

In the present embodiment, the FI-ECU 5 corresponds to a fuel injection parameter calculating unit and a driving unit, the CPS-ECU 4 corresponds to a sensor output signal processing unit, and the RAM 16 corresponds to a storage unit.

First Modification

The previous value replacement process in Step S53 in FIG. 9 may be replaced with an estimated motoring pressure replacement process described below.

In the estimated motoring pressure replacement process, an estimated motoring pressure PCYLME is calculated by using a technique disclosed in Japanese Patent Application No. 4241581, the entire contents of which are incorporated herein by reference and which is applied by the applicant of the present disclosure, and the cylinder internal pressure signal after the noise reduction PCNR during the noise reduction period CAPNR is set to the estimated motoring pressure PCYLME calculated before one combustion cycle if the noise reduction period CAPNR includes the cylinder internal pressure increasing period CAPPUP. The estimated motoring pressure PCYLME is calculated for every certain crank angle and is stored in the RAM 16.

According to the technique disclosed in Japanese Patent Application No. 4241581, the estimated motoring pressure PCYLME is calculated according to Equation (11):

$$PCYLME=(GRT/VC)\times k+C \tag{11}$$

In Equation (11), G denotes the amount of intake air flow GAIR detected by a sensor or the amount of intake air flow of the engine calculated in accordance with the number of revolutions NE of the engine and the intake air pressure PBA, R denotes a gas constant, T denotes the intake air temperature TA that is detected or an intake air temperature estimated on the basis of, for example, the cooling water temperature TW of the engine, and VC denotes a combustion chamber volume. In Equation (11), k and C denote a correction factor and a correction constant and are hereinafter referred to as "estimated model parameters." The combustion chamber volume VC is calculated in accordance with the crank angle that is detected.

The estimated model parameters k and C are identified by using a least square method so that the difference between the cylinder internal pressure sensor output signal PCYL and the estimated motoring pressure PCYLME calculated according to Equation (11) is minimized.

Since the estimated motoring pressure PCYLME calculated in the above manner has a high precision in which the effect of the operation state of the engine is reflected, setting the cylinder internal pressure signal after the noise reduction PCNR to the estimated motoring pressure PCYLME allows the fuel injection noise when the noise reduction period CAPNR includes the cylinder internal pressure increasing period CAPPUP to be appropriately reduced.

Second Modification

The previous value replacement process in Step S53 in FIG. 9 may be replaced with a motoring waveform $\epsilon$ filter process described below.

In the motoring waveform $\epsilon$ filter process, the cylinder internal pressure signal after the noise reduction PCNR is set to the cylinder internal pressure sensor output signal PCYL (Equation (22) described below) if Equation (21) described below is established and is set to a motoring waveform value PCYLM (Equation (23) described below) if Equation (21) is not established (that is, PCYL<PCYLM−$\epsilon$ or PCYL>PCYLM+$\epsilon$). The motoring waveform value PCYLM is the value of the cylinder internal pressure sensor output signal during a fuel cutting operation. The "estimated motoring pressure PCYLME calculated before one combustion cycle" described in First modification may be used as the motoring waveform value PCYLM.

$$PCYLM-\beta PCYL\leq PCYLM+\epsilon \tag{21}$$

$$PCNR=PCYL \tag{22}$$

$$PCNR=PCYLM \tag{23}$$

Figure 10:
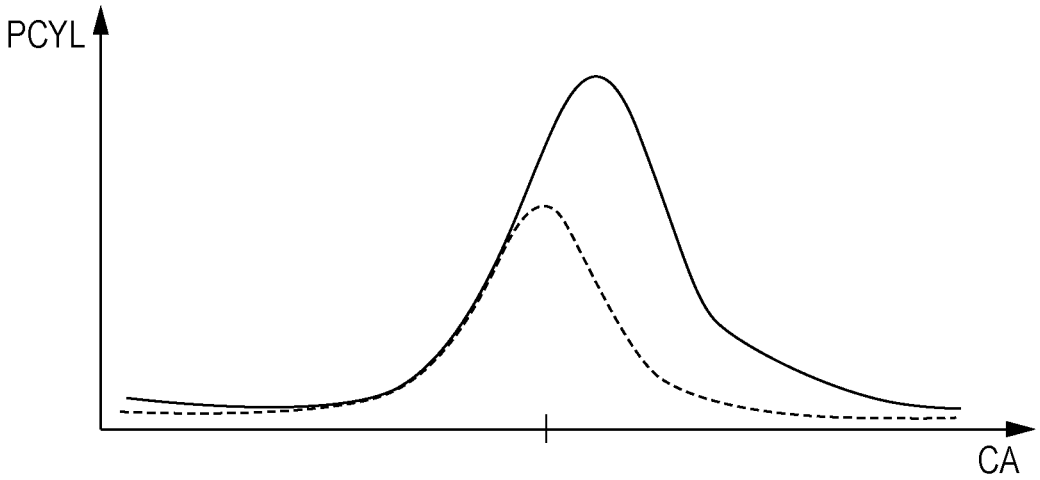
FIG. 10 is a graph in which a cylinder internal pressure waveform (dotted line) during a fuel cutting operation and a cylinder internal pressure waveform (solid line) during a normal operation are illustrated.

FIG. 10 is a graph in which a waveform (hereinafter referred to as a "motoring waveform") of the cylinder internal pressure sensor output signal PCYL during the fuel cutting operation is compared with a waveform (hereinafter referred to as a "normal operation waveform") of the cylinder internal pressure sensor output signal PCYL during the normal operation of the engine. Referring FIG. 10, a dotted line denotes the motoring waveform and a solid line denotes the normal operation waveform. FIG. 10 indicates that the normal operation waveform is substantially the same as the motoring waveform during the compression process and, when the fuel injection noise is increased, the replacement with the motoring waveform value PCYLM allows the fuel injection noise to be appropriately reduced.

According to the second modification, when the noise reduction period CAPNR include the cylinder internal pressure increasing period CAPPUP, the cylinder internal pressure sensor output signal PCYL is directly set as the cylinder internal pressure signal after the noise reduction PCNR if the cylinder internal pressure sensor output signal PCYL is within a second allowable range defined by (the motoring waveform value PCYLM±ϵ), the motoring waveform value PCYLM is output as the cylinder internal pressure signal after the noise reduction PCNR if the cylinder internal pressure sensor output signal PCYL is outside the second allowable range, and the motoring waveform value PCYLM is set to the value of the cylinder internal pressure sensor output signal acquired during the fuel cutting operation. Since the cylinder internal pressure during the fuel injection execution period CAPFI is the pressure before an increase in pressure occurs due to ignition of the fuel, it is possible to approximate the cylinder internal pressure during the fuel injection execution period CAPFI to the motoring waveform value PCYLM acquired during the fuel cutting operation. Accordingly, setting the cylinder internal pressure signal after the noise reduction PCNR to the motoring waveform value PCYLM when the cylinder internal pressure sensor output signal PCYL is outside the second allowable range allows the fuel injection noise during the cylinder internal pressure increasing period CAPPUP to be appropriately reduced.

Third Modification

The previous value replacement process in Step S53 in FIG. 9 may be replaced with a linear interpolation process described below.

In the linear interpolation operation, a cylinder internal pressure sensor output signal value PCYLNS at the noise reduction start time CANS and a cylinder internal pressure sensor output signal value PCYLNE at the noise reduction end time CANE are applied to Equation (31) described below to calculate a cylinder internal pressure signal after the noise reduction PCNR(i) (i: index parameter):

$$PCNR(i)=PCYLNS+(PCYLNE-PCYLNS)\times(i-iNRS)/(iNRE-iNRS) \quad (31)$$

In Equation (31), iNRS and iNRE are index parameter values corresponding to the noise reduction start time CANS and the noise reduction end time CANE, respectively.

Since the cylinder internal pressure sensor output signal PCYL does not greatly vary during the pressure increasing period if there is no effect of the fuel injection noise, the linear interpolation operation allows the fuel injection noise during the cylinder internal pressure increasing period CAPPUP to be appropriately reduced.

Fourth Modification

Figures 11A, 11B, 11C, 11D:
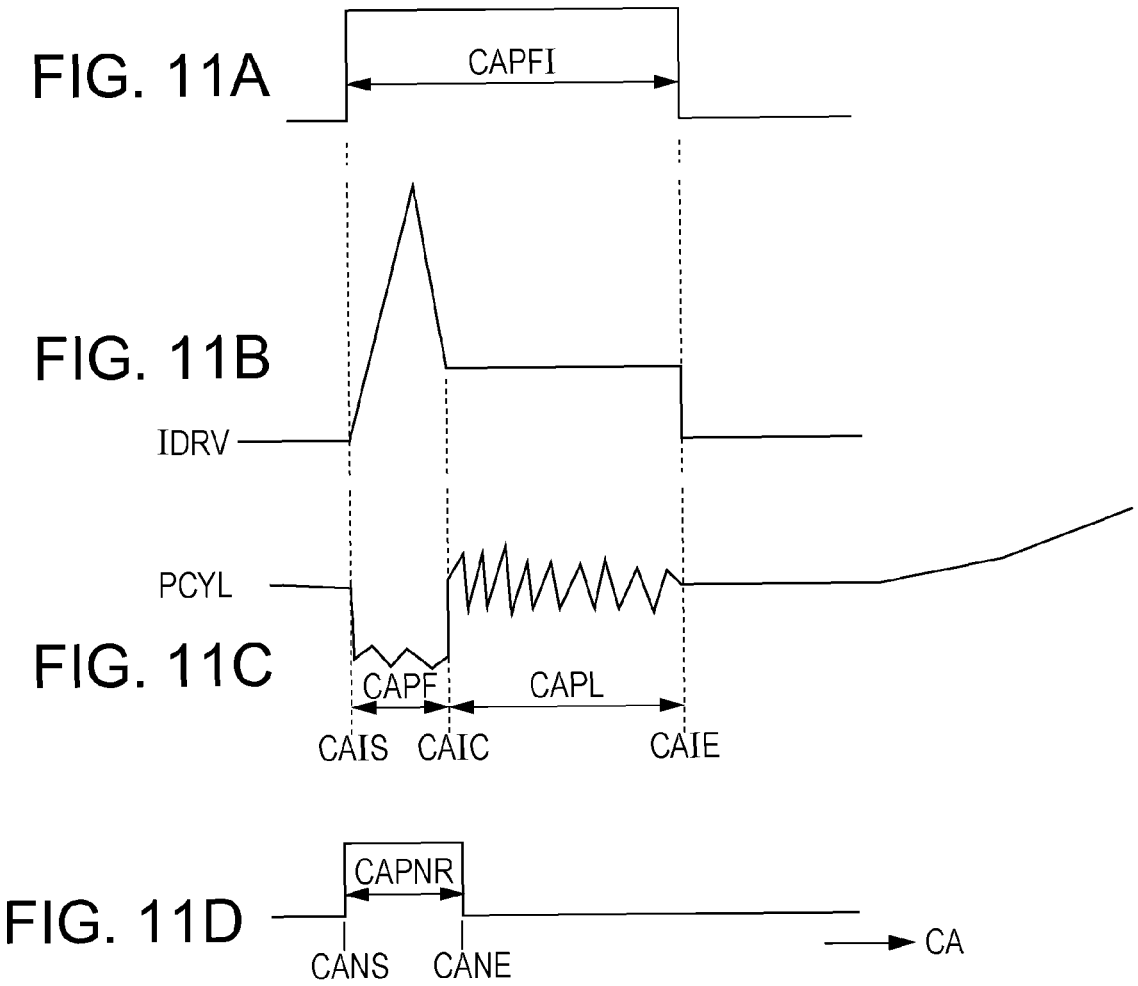
FIGS. 11A to 11D are time charts for describing a technique to set the noise reduction period.

The noise reduction period CAPNR may be set in a manner illustrated in FIG. 11D. FIG. 11A illustrates the fuel injection execution period CAPFI and FIG. 11B illustrates how a fuel injection valve drive current IDRV is varied during the fuel injection execution period CAPFI. FIG. 11A and FIG. 11B indicate that the fuel injection valve drive current IDRV is controlled so that the fuel injection valve drive current IDRV is greatly varied during a period (hereinafter referred to as a "former period CAPF") from the fuel injection start time CAIS to a waveform change time CAIC, the fuel injection valve drive current IDRV is kept at a substantially constant value during a period (hereinafter referred to as a "late period CAPL") from the waveform change time CAIC to the fuel injection end time CAIE, and the fuel injection valve drive current IDRV becomes "0" at the fuel injection end time CAIE. Accordingly, the fuel injection noise mixed into the cylinder internal pressure sensor output signal PCYL is large during the former period CAPF and is relatively small during the late period CAPL. In addition, since the magnitude of the fuel injection valve drive current IDRV is controlled by varying the duty of a pulse signal of a certain frequency fDRV, the main frequency component of the fuel injection noise during the late period CAPL corresponds to the certain frequency fDRV. Accordingly, it is possible to effectively reduce the fuel injection noise during the late period CAPL with a common band pass filter.

Consequently, setting the noise reduction period CAPNR to the manner illustrated in FIG. 11D also allows the large fuel injection noise to be reliably reduced. The noise reduction period CAPNR illustrated in FIG. 11D is set by adding the certain margin period CAPMGN before and after the former period CAPF.

As described above, according to the fourth modification, the noise reduction start time CANS of the noise reduction period CAPNR is set to a time the certain margin period CAPMGN before the fuel injection start time CAIS and the noise reduction end time CANE of the noise reduction period CAPNR is set to a time the certain margin period CAPMGN after the waveform change time CAIC. Accordingly, it is possible to reliably reduce the fuel injection noise during the former period CAPF in which the fuel injection noise is increased. In addition, the noise reduction period CAPNR may be set to a minimum period to relieve the effect of the noise reduction process.

The present disclosure is not limited to the embodiments described above and various modifications can be made in the present disclosure. For example, although the cylinder internal pressure sensor output signal is sampled for every one-degree crank angle in the above embodiments, the embodiments are not limited to this. The cylinder internal pressure sensor output signal may be sampled at a certain sampling frequency fSMP (for example, 50 kHz) and the sampling data may be converted into data for every certain crank angle (for example, 0.5 degrees to one degree) in accordance with the number of revolutions NE of the engine.

Alternatively, a compression process model waveform value PCYLMP applied during the compression period and an expansion process model waveform value PCYLMEX applied during an expansion period may be set in advance and stored in the ROM 15 and, when the difference between the cylinder internal pressure sensor output signal PCYL and either of the model waveform values exceeds a certain allowable range predetermined value ϵ, the cylinder internal pressure signal after the noise reduction PCNR may be set to the model waveform value. In this modification, it is not necessary to set the noise reduction period CAPNR in accordance with the fuel injection parameters (INJSTG, TOFF, and TON).

Figure 12:
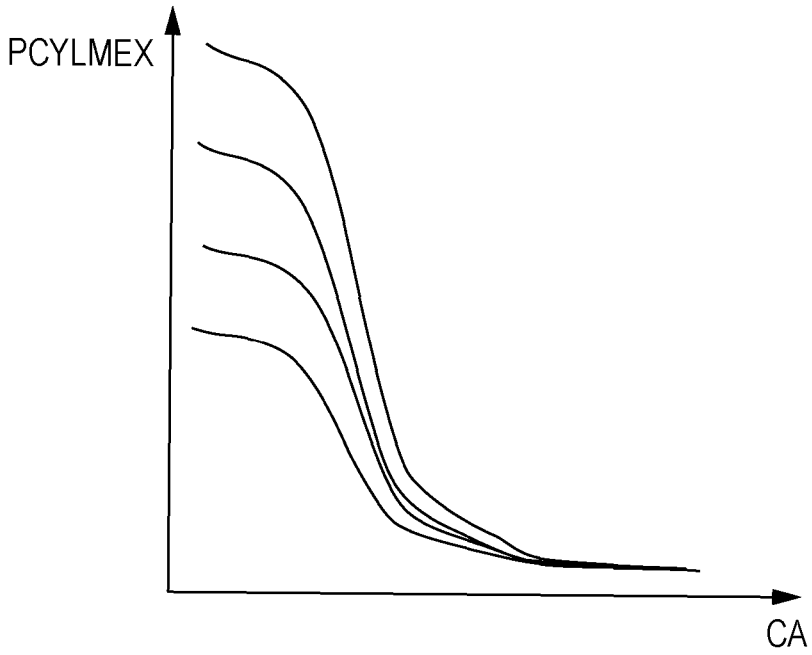
FIG. 12 is a time chart illustrating an example of how expansion process model waveforms are set.

It is desirable that the motoring waveform value PCYLM illustrated by the dotted line in FIG. 10 be used as the compression process model waveform value PCYLMP. It is desirable that the expansion process model waveform values PCYLMEX of a certain number be stored in advance in the ROM 15 in a manner illustrated in FIG. 12, and that one of the expansion process model waveform values PCYLMEX that are stored be selected for use in accordance with a maximum value PMAX among the detected cylinder internal pressures and the amount of intake air flow GAIR of the engine or two of the expansion process model waveform values PCYLMEX that are stored be selected to calculate the expansion process model waveform value PCYLMEX by the interpolation corresponding to the maximum value PMAX and the amount of intake air flow GAIR.

According to an aspect of the embodiment, a control apparatus for an internal combustion engine including a fuel injection valve (7) that injects fuel into a combustion chamber of the internal combustion engine (1) includes a cylinder internal pressure sensor (2) configured to be integrated with the fuel injection valve (7) and to detect cylinder internal pressure in the combustion chamber; a fuel injection parameter calculating unit configured to calculate an opening time (TON) and an opening start time (INJSTG, TOFF) of the fuel injection valve (7) in accordance with an operation state of the engine; a driving unit configured to drive the fuel injection valve (7) in accordance with the opening time and the opening start time that are calculated; and a sensor output signal processing unit configured to generate a cylinder internal pressure detection signal (PCNR) from a cylinder internal pressure sensor output signal (PCYL) from the cylinder internal pressure sensor. The sensor output signal processing unit sets a noise reduction period (CAPNR) in accordance with the opening time and the opening start time (TON, INJSTG, TOFF) of the fuel injection valve and reduces noise that is included in the cylinder internal pressure sensor output signal (PCYL) and that is caused by the opening of the fuel injection valve during the noise reduction period.

In the control apparatus according to the embodiment, when the noise reduction period (PCNR) does not include a compression process period (CAPPUP) in which the cylinder internal pressure increases, the sensor output signal processing unit may directly output the value of the cylinder internal pressure sensor output signal (PCYL) as the cylinder internal pressure detection signal (PCNR) if the value of the cylinder internal pressure sensor output signal (PCYL) is within a first allowable range defined by (a first reference value (PCYLAV) $\pm\epsilon$) ($\epsilon$ is a certain allowable range predetermined value) and may output the first reference value (PCYLAV) as the cylinder internal pressure detection signal (PCNR) if the value of the cylinder internal pressure sensor output signal (PCYL) is outside the first allowable range. The first reference value (PCYLAV) may be set to an average of the values of the cylinder internal pressure sensor output signals during a certain averaging period (CAPAV) immediately before the noise reduction period (CAPNR).

In the control apparatus according to the embodiment, the sensor output signal processing unit may include a storage unit that stores the value of the cylinder internal pressure sensor output signal (PCYL). When the noise reduction period (CAPNR) includes a compression process period (CAPPUP) in which the cylinder internal pressure increases, the cylinder internal pressure detection signal (PCNR) during the noise reduction period (CAPNR) may be set to the value of the cylinder internal pressure sensor output signal (PCYL) acquired before one combustion cycle.

In the control apparatus according to the embodiment, the sensor output signal processing unit may include an estimated motoring pressure calculating unit that calculates an estimated motoring pressure (PCYLME) in accordance with a rotation angle of a crank shaft of the engine and a storage unit that stores the calculated estimated motoring pressure (PCYLME). When the nose reduction period (CAPNR) includes a compression process period (CAPPUP) in which the cylinder internal pressure increases, the cylinder internal pressure detection signal during the noise reduction period (CAPNR) may be set to the value of the estimated motoring pressure (PCYLME) calculated before one combustion cycle.

In the control apparatus according to the embodiment, when the noise reduction period (CAPNR) includes a compression process period (CAPPUP) in which the cylinder internal pressure increases, the sensor output signal processing unit may calculate an interpolation signal value by linear interpolation based on the value of the cylinder internal pressure sensor output signal (PCYLNS) at a start time (CANS) of the noise reduction period and the value of the cylinder internal pressure sensor output signal (PCYLNE) at an end time (CANE) of the noise reduction period (Equation (21)) and may set the cylinder internal pressure detection signal (PCNR) during the noise reduction period (CAPNR) to the interpolation signal value.

In the control apparatus according to the embodiment, when the noise reduction period (CAPNR) includes a compression process period (CAPPUP) in which the cylinder internal pressure increases, the sensor output signal processing unit may directly output the value of the cylinder internal pressure sensor output signal (PCYL) as the cylinder internal pressure detection signal (PCNR) if the value of the cylinder internal pressure sensor output signal (PCYL) is within a second allowable range defied by (a second reference value (PCYLM$\pm\epsilon$) and may output the second reference value (PCYLM) as the cylinder internal pressure detection signal (PCNR) if the value of the cylinder internal pressure sensor output signal (PCYL) is outside the second allowable range. The second reference value (PCYLM) may be set to the value of the cylinder internal pressure sensor output signal (PCYL) acquired during a fuel cutting operation of the engine.

In the control apparatus according to the embodiment, the sensor output signal processing unit may include an estimated motoring pressure calculating unit that calculates an estimated motoring pressure (PCYLME) in accordance with a rotation angle of a crank shaft of the engine and a storage unit that stores the calculated estimated motoring pressure (PCYLME). When the noise reduction period (CAPNR) includes a compression process period (CAPPUP) in which the cylinder internal pressure increases, the sensor output signal processing unit may directly output the value of the cylinder internal pressure sensor output signal (PCYL) as the cylinder internal pressure detection signal (PCNR) if the value of the cylinder internal pressure sensor output signal (PCYL) is within a second allowable range defied by (a second reference value (PCYLME)$\pm\epsilon$) and may output the second reference value (PCYLME) as the cylinder internal pressure detection signal if the value of the cylinder internal pressure sensor output signal (PCLY) is outside the second allowable range. The second reference value (PCYLME) may be set to the value of the estimated motoring pressure (PCYLME) calculated before one combustion cycle.

In the control apparatus according to the embodiment, a start time (CANS) of the noise reduction period may be set to a time a certain margin period (CAPMGN) before the opening start time (CAIS) of the fuel injection valve and an end time (CANE) of the noise reduction period may be set to a time when the opening time (TON) and the certain margin period (CAPMGN) elapsed since the opening start time (CAIS).

In the control apparatus according to the embodiment, a start time (CANS) of the noise reduction period may be set to a time a certain margin period (CAPMGN) before the opening start time (CAIS) of the fuel injection valve and an end time (CANE) of the noise reduction period may be set to a time the certain margin period (CAPMGN) after a waveform change time (CAIC) of a drive signal supplied to the fuel injection valve.

In the control apparatus according to the embodiment, the driving unit may include a drive circuit (6) that supplies drive current to the fuel injection valve (7) and the drive circuit (6) may be provided for each cylinder in the engine.

According to the embodiment, the noise reduction period is set in accordance with the opening time and the opening start time of the fuel injection valve and the process of reducing the noise (the fuel injection noise) that is included in the cylinder internal pressure sensor output signal and that is caused by the opening of the fuel injection valve is performed during the noise reduction period to generate the cylinder internal pressure detection signal. Since the fuel injection noise occurs while the fuel injection is being performed, setting the noise reduction period in accordance with the opening time and the opening start time of the fuel injection valve allows the noise reduction period to be appropriately set. Performing an arithmetic process having a noise reduction effect higher than that of the normal filter process during the noise reduction period allows the fuel injection noise to be effectively reduced. Consequently, the internal combustion engine is controlled by using the cylinder internal pressure detection signal in which the fuel injection noise is reduced to prevent a reduction in precision of the control.

When the noise reduction period of the embodiment does not include the compression process period in which the cylinder internal pressure increases, the value of the cylinder internal pressure sensor output signal is directly output as the cylinder internal pressure detection signal if the value of the cylinder internal pressure sensor output signal is within the first allowable range defined by (the first reference value$\pm\epsilon$), the first reference value is output as the cylinder internal pressure detection signal if the value of the cylinder internal pressure sensor output signal is outside the first allowable range, and the first reference value is set to the average of the values of the cylinder internal pressure sensor output signals during the certain averaging period immediately before the noise reduction period. Since the fuel injection is performed before the cylinder internal pressure starts to increase or while the cylinder internal pressure is increasing, it is possible to approximate the value of the cylinder internal pressure detection signal to a constant value when the noise reduction period does not include the compression process period. Accordingly, setting the cylinder internal pressure detection signal to the first reference value when the value of the cylinder internal pressure sensor output signal is outside the first allowable range allows the large fuel injection noise to be appropriately reduced.

When the noise reduction period of the embodiment includes the compression process period, the cylinder internal pressure detection signal during the noise reduction period is set to the value of the cylinder internal pressure sensor output signal acquired before one combustion cycle. Since the fuel injection performed during the compression process period is the additional fuel injection after the main injection and is not constantly performed, the application of the value of the cylinder internal pressure sensor output signal acquired before one combustion cycle allows the fuel injection noise during the compression process period to be appropriately reduced.

When the noise reduction period of the embodiment includes the compression process period, the cylinder internal pressure detection signal during the noise reduction period is set to the value of the estimated motoring pressure calculated before one combustion cycle. Since the value of the estimated motoring pressure is calculated in accordance with the operation state of the engine and the effect of the operation state of the engine is reflected in the estimated motoring pressure, the application of the estimated motoring pressure calculated before one combustion cycle allows the fuel injection noise during the compression process period to be appropriately reduced.

When the noise reduction period of the embodiment includes the compression process period, the interpolation signal value is calculated by the linear interpolation based on the value of the cylinder internal pressure sensor output signal at the start time of the noise reduction period and the value of the cylinder internal pressure sensor output signal at the end time of the noise reduction period and the cylinder internal pressure detection signal during the noise reduction period is set to the interpolation signal value. Since the cylinder internal pressure sensor output signal does not greatly vary during the pressure increasing period if there is no effect of the fuel injection noise, the linear interpolation operation allows the fuel injection noise during the compression process period to be appropriately reduced.

When the noise reduction period of the embodiment includes the compression process period, the value of the cylinder internal pressure sensor output signal is directly output as the cylinder internal pressure detection signal if the value of the cylinder internal pressure sensor output signal is within the second allowable range defied by (the second reference value$\pm\epsilon$), the second reference value is output as the cylinder internal pressure detection signal if the value of the cylinder internal pressure sensor output signal is outside the second allowable range, and the second reference value is set to the value of the cylinder internal pressure sensor output signal acquired during the fuel cutting operation. Since the cylinder internal pressure during the fuel injection execution period is the pressure before an increase in pressure occurs due to ignition of the fuel, it is possible to approximate the cylinder internal pressure during the fuel injection execution period to the value of the cylinder internal pressure sensor output signal acquired during the fuel cutting operation. Accordingly, setting the cylinder internal pressure detection signal to the second reference value if the value of the cylinder internal pressure sensor output signal is outside the second allowable range allows the fuel injection noise during the compression process period to be appropriately reduced.

When the noise reduction period of the embodiment includes compression process period, the value of the cylinder internal pressure sensor output signal is directly output as the cylinder internal pressure detection signal if the value of the cylinder internal pressure sensor output signal is within the second allowable range defied by (the second reference value$\pm\epsilon$), the second reference value is output as the cylinder internal pressure detection signal if the value of the cylinder internal pressure sensor output signal is outside the second allowable range, and the second reference value is set to the value of the estimated motoring pressure calculated before one combustion cycle. The value of the estimated motoring pressure is calculated in accordance with the operation state of the engine and the effect of the operation state of the engine is reflected in the estimated motoring pressure. Accordingly, setting the cylinder internal pressure detection signal to the second reference value when the value of the cylinder internal pressure sensor output signal is outside the second allowable range allows the fuel injection noise during the compression process period to be appropriately reduced.

The start time of the noise reduction period is set to a time a certain margin period before the opening start time of the fuel injection valve and the end time of the noise reduction period is set to a time when the opening time and the certain margin period elapsed since the opening start time. Accordingly, it is possible to reliably reduce the fuel injection noise.

The start time of the noise reduction period is set to a time a certain margin period before the opening start time of the fuel injection valve and the end time of the noise reduction period is set to a time the certain margin period after the waveform change time of the drive signal supplied to the fuel injection valve. Since the drive signal supplied to the fuel injection valve is sharply varied at the start of the fuel injection, the fuel injection noise tends to increase. Accordingly, setting the end time of the noise reduction period to a time the certain margin period after the waveform change time of the drive signal supplied to the fuel injection valve allows the noise reduction period to be set to a minimum period to relieve the effect of the noise reduction process.

The drive circuit that supplies the drive current to the fuel injection valve is provided for each cylinder in the engine. It is found that, in the configuration in which one drive circuit for the fuel injection valve is provided for every two cylinders and the two fuel injection valves are switched for driving, the cylinder internal pressure sensor output signal from one cylinder is likely to be affected by the fuel injection noise caused by the fuel injection in the other cylinder. Accordingly, the provision of the drive circuit for each cylinder in the engine allows the effect of the noise caused by the fuel injection in another cylinder to be reduced.

Obviously, numerous modifications and variations of the present invention are possible in light of the above teachings. It is therefore to be understood that within the scope of the appended claims, the invention may be practiced otherwise than as specifically described herein.

What is claimed is:

1. A control apparatus for an internal combustion engine, the control apparatus comprising:

a cylinder internal pressure sensor to be integrated with a fuel injection valve provided to inject fuel into a combustion chamber of the internal combustion engine, the cylinder internal pressure sensor being configured to detect cylinder internal pressure in the combustion chamber;

a fuel injection parameter calculator configured to calculate an opening time and an opening start time of the fuel injection valve in accordance with an operation state of the internal combustion engine;

a driving device to drive the fuel injection valve in accordance with the opening time and the opening start time that are calculated by the fuel injection parameter calculator; and a sensor output signal processing device configured to generate a cylinder internal pressure detection signal based on a cylinder internal pressure sensor output signal output from the cylinder internal pressure sensor, the sensor output signal processing device being configured to set a noise reduction period in accordance with the opening time and the opening start time of the fuel injection valve and configured to reduce, during the noise reduction period, noise that is included in the cylinder internal pressure sensor output signal and that is caused by opening of the fuel injection valve.

2. The control apparatus for the internal combustion engine according to claim 1, wherein, when the noise reduction period does not include a compression process period in which the cylinder internal pressure increases, the sensor output signal processing device outputs a value of the cylinder internal pressure sensor output signal as the cylinder internal pressure detection signal if the value of the cylinder internal pressure sensor output signal is within a first allowable range defined by a first reference value±ϵ where "ϵ" is a certain allowable range predetermined value, and outputs the first reference value as the cylinder internal pressure detection signal if the value of the cylinder internal pressure sensor output signal is outside the first allowable range, and wherein the first reference value is set to an average of values of cylinder internal pressure sensor output signals output from the cylinder internal pressure sensor during a certain averaging period immediately before the noise reduction period.

3. The control apparatus for the internal combustion engine according to claim 1, wherein the sensor output signal processing device includes a storage device configured to store a value of the cylinder internal pressure sensor output signal, and wherein, when the noise reduction period includes a compression process period in which the cylinder internal pressure increases, the cylinder internal pressure detection signal during the noise reduction period is set to the value of the cylinder internal pressure sensor output signal acquired before one combustion cycle of the internal combustion engine.

4. The control apparatus for the internal combustion engine according to claim 1, wherein the sensor output signal processing device includes an estimated motoring pressure calculator configured to calculate an estimated motoring pressure in accordance with a rotation angle of a crank shaft of the internal combustion engine, and a storage device configured to store the estimated motoring pressure calculated by the estimated motoring pressure calculator, and wherein, when the noise reduction period includes a compression process period in which the cylinder internal pressure increases, the cylinder internal pressure detection signal during the noise reduction period is set to a value of the estimated motoring pressure calculated before one combustion cycle of the internal combustion engine.

5. The control apparatus for the internal combustion engine according to claim 1, wherein, when the noise reduction period includes a compression process period in which the cylinder internal pressure increases, the sensor output signal processing device calculates an interpolation signal value by linear interpolation based on a value of the cylinder internal pressure sensor output signal at a start time of the noise reduction period and a value of the cylinder internal pressure sensor output signal at an end time of the noise reduction period and sets the cylinder internal pressure detection signal during the noise reduction period to the interpolation signal value.

6. The control apparatus for the internal combustion engine according to claim 1, wherein, when the noise reduction period includes a compression process period in which the cylinder internal pressure increases, the sensor output signal processing device outputs a value of the cylinder internal pressure sensor output signal as the cylinder internal pressure detection signal if the value of the cylinder internal pressure sensor output signal is within a second allowable range defied by a second reference value±ϵ where "ϵ" is a certain allowable range predetermined value, and outputs the second reference value as the cylinder internal pressure detection signal if the value of the cylinder internal pressure sensor output signal is outside the second allowable range, and wherein the second reference value is set to the value of the cylinder internal pressure sensor output signal acquired during a fuel cutting operation of the internal combustion engine.

7. The control apparatus for the internal combustion engine according to claim 1, wherein the sensor output signal processing device includes an estimated motoring pressure calculator configured to calculate an estimated motoring pressure in accordance with a rotation angle of a crank shaft of the internal combustion engine, and a storage device configured to store the estimated motoring pressure calculated by the estimated motoring pressure calculator, wherein, when the noise reduction period includes a compression process period in which the cylinder internal pressure increases, the sensor output signal processing device directly outputs a value of the cylinder internal pressure sensor output signal as the cylinder internal pressure detection signal if the value of the cylinder internal pressure sensor output signal is within a second allowable range defied by a second reference value$\pm\epsilon$ where "$\epsilon$" is a certain allowable range predetermined value, and outputs the second reference value as the cylinder internal pressure detection signal if the value of the cylinder internal pressure sensor output signal is outside the second allowable range, and wherein the second reference value is set to a value of the estimated motoring pressure calculated before one combustion cycle of the internal combustion engine.

8. The control apparatus for the internal combustion engine according to claim 1, wherein a start time of the noise reduction period is set to a time a certain margin period before the opening start time of the fuel injection valve, and wherein an end time of the noise reduction period is set to a time when the opening time and the certain margin period elapsed since the opening start time.

9. The control apparatus for the internal combustion engine according to claim 1, wherein a start time of the noise reduction period is set to a time a certain margin period before the opening start time of the fuel injection valve and an end time of the noise reduction period is set to a time the certain margin period after a waveform change time of a drive signal supplied to the fuel injection valve.

10. The control apparatus for the internal combustion engine according to claim 1, wherein the driving device includes a drive circuit configured to supply a drive current to the fuel injection valve, and wherein the drive circuit is provided for each cylinder in the internal combustion engine.

11. A control apparatus for an internal combustion engine, the control apparatus comprising:

cylinder internal pressure detecting means for detecting cylinder internal pressure in a combustion chamber of the internal combustion engine, the cylinder internal pressure detecting means being to be integrated with a fuel injection valve provided to inject fuel into the combustion chamber;

fuel injection parameter calculating means for calculating an opening time and an opening start time of the fuel injection valve in accordance with an operation state of the internal combustion engine;

driving means for driving the fuel injection valve in accordance with the opening time and the opening start time that are calculated by the fuel injection parameter calculating means; and sensor output signal processing means for generating a cylinder internal pressure detection signal based on a cylinder internal pressure detecting means output signal output from the cylinder internal pressure detecting means, the sensor output signal processing means being for setting a noise reduction period in accordance with the opening time and the opening start time of the fuel injection valve and for reducing, during the noise reduction period, noise that is included in the cylinder internal pressure detecting means output signal and that is caused by opening of the fuel injection valve.

12. A method of controlling an internal combustion engine, the method comprising:

detecting cylinder internal pressure in a combustion chamber of the internal combustion engine using a cylinder internal pressure sensor integrated with a fuel injection valve provided to inject fuel into the combustion chamber;

calculating an opening time and an opening start time of the fuel injection valve in accordance with an operation state of the internal combustion engine;

driving the fuel injection valve in accordance with the opening time and the opening start time that are calculated in the calculating of the opening time and the opening start time;

generating a cylinder internal pressure detection signal based on the cylinder internal pressure detected in the detecting of the cylinder internal pressure;

setting a noise reduction period in accordance with the opening time and the opening start time of the fuel injection valve; and reducing, during the noise reduction period, noise that is included in a signal of the cylinder internal pressure detected in the detecting of the cylinder internal pressure and that is caused by opening of the fuel injection valve.

13. A computer-readable storage medium storing a program for causing a computer to execute a process comprising:

detecting cylinder internal pressure in a combustion chamber of the internal combustion engine using a cylinder internal pressure sensor integrated with a fuel injection valve provided to inject fuel into the combustion chamber;

calculating an opening time and an opening start time of the fuel injection valve in accordance with an operation state of the internal combustion engine;

driving the fuel injection valve in accordance with the opening time and the opening start time that are calculated in the calculating of the opening time and the opening start time;

generating a cylinder internal pressure detection signal based on the cylinder internal pressure detected in the detecting of the cylinder internal pressure;

setting a noise reduction period in accordance with the opening time and the opening start time of the fuel injection valve; and reducing, during the noise reduction period, noise that is included in a signal of the cylinder internal pressure detected in the detecting of the cylinder internal pressure and that is caused by opening of the fuel injection valve.

* * * * *